US005343180A

United States Patent [19]

Fukumoto et al.

[11] Patent Number: 5,343,180

[45] Date of Patent: Aug. 30, 1994

[54] COIL STRUCTURE AND COIL CONTAINER

[75] Inventors: Hideshi Fukumoto; Yoko Kameoka, both of Hitachi; Ken Yoshioka, Hitachiota; Teruhiro Takizawa, Hitachi; Tadasi Sonobe, Iwaki; Fumio Suzuki; Naoki Kasahara, both of Hitachi; Fumihiko Goto, Katsuta; Shigeru Sakamoto, Chiyodamachi; Masayuki Shibata, Hitachi, all of Japan

[73] Assignees: Hitachi, Ltd., Tokyo; Hitachi Engineering Co., Ltd., Hitachi, both of Japan

[21] Appl. No.: 857,251

[22] Filed: Mar. 25, 1992

[30] Foreign Application Priority Data

Mar. 25, 1991 [JP] Japan ..... 3-059958

[51] Int. Cl.[5] ..... H01F 1/00; H01F 5/00; F25B 19/00

[52] U.S. Cl. ..... 335/216; 335/300; 62/51.1; 336/DIG. 1

[58] Field of Search ..... 335/216, 301, 300; 62/51.1

[56] References Cited

U.S. PATENT DOCUMENTS

| | | | |
|---|---|---|---|
| 3,360,692 | 12/1967 | Kafka | 335/216 |
| 4,833,434 | 5/1989 | Takechi | 335/217 |
| 5,148,137 | 9/1992 | Purcell | 335/301 |

FOREIGN PATENT DOCUMENTS

| | | | |
|---|---|---|---|
| 62-29113 | 2/1987 | Japan . | |
| 62-165901 | 7/1987 | Japan . | |
| 62-183503 | 8/1987 | Japan . | |
| 63-187606 | 8/1988 | Japan . | |
| 1-74708 | 3/1989 | Japan . | |
| 0115107 | 5/1989 | Japan | 335/216 |
| 0325808 | 2/1991 | Japan | 335/216 |

*Primary Examiner*—Leo P. Picard
*Assistant Examiner*—Stephen T. Ryan
*Attorney, Agent, or Firm*—Antonelli, Terry, Stout & Kraus

[57] ABSTRACT

There is disclosed a coil structure which can be rapidly energized or excited, and which reduces the generation of heat in a coil container by an eddy current due to a dynamic disturbance such as vibration and a magnetic field fluctuation, thereby suppressing the occurrence a quench. The coil container is constituted by a low-resistivity material, and a high-resistivity portion is provided at at least one portion of the coil container in the direction of the periphery of the coil container. The high-resistivity portion is provided at a position where a vibration displacement is small or a magnetic field fluctuation is small. When the coil structure is to be energized or excited, the eddy current produced in the direction of the periphery of the superconducting-coil container can be reduced at the high-resistivity portion, and when the dynamic disturbance develops, the generation of heat by the eddy current is suppressed by the low-resistivity material.

21 Claims, 7 Drawing Sheets

COIL STRUCTURE AND COIL CONTAINER

BACKGROUND OF THE INVENTION

1. Field of the Invention

This invention relates to a coil structure (hereinafter referred to as a "superconducting magnet") which generates a strong or high magnetic field when an electric current flows through a coil such as a superconducting coil, and more particularly to a superconducting magnet structure which can suitably prevent a change from a superconducting state to a normal state (hereinafter referred to as a "quench") when a dynamic disturbance, such as vibration and an external magnetic field variation or fluctuation, is applied to the superconducting magnet.

2. Description of the Related Art

FIG. 2 shows a conventional superconducting magnet. In FIG. 2, reference numeral 1 denotes a superconducting coil, reference numeral 2 a superconducting-coil container, reference numeral 3 a radiation shield, reference numeral 4 a heat-insulating vacuum vessel, and reference numeral 5 a support member. The superconducting coil 1 is cooled to a liquid helium temperature, and in most cases, generates a strong magnetic field when a constant current flows therethrough. The superconducting-coil container 2 holds the superconducting coil 1 and a cooling medium (liquid helium) therein, and supports the superconducting coil 1 against an electromagnetic force, such as a hoop force, produced in the superconducting coil 1. Therefore, generally, the superconducting-coil container 2 is made of a high-rigidity material such as stainless steel. The radiation shield 3 is provided for the purpose of preventing radiated heat from affecting the liquid helium temperature portion, and is disposed in spaced relation to the superconducting-coil container 2 and the heat-insulating vacuum vessel 4. The radiation shield 3 is made of a material with a good thermal conductivity, such as aluminum. The heat-insulating vacuum vessel 4 maintains a vacuum to thereby shield heat from the exterior. The vacuum vessel 4 is made, for example, of a high-rigidity material such as stainless steel, or a thick material in order to withstand the vacuum force. The support member 5 supports the superconducting-coil container 2, together with the superconducting coil 1, and the radiation shield 3 within the heat-insulating vacuum vessel 4 in a suspended manner. The support member 5 is made of a highly heat-insulating material. In the above liquid helium-cooled superconducting magnet, when the temperature of the superconducting coil 1 rises due to the transfer of external heat, the superconducting state is destroyed or quenched, and the current flowing in the superconducting coil is rapidly attenuated (this phenomenon is known as a "quench".) When the quench occurs, the magnetic field expected to be produced by the superconducting magnet cannot be maintained, and besides in accordance with the attenuation of the superconducting coil current, an eddy current is induced in the associated circumferential parts, such as the radiation shield, which results in a problem that the associated parts are deformed by an electromagnetic force produced by this eddy current. Therefore, in the design of the superconducting coil, it is most important to avoid such heat entry or transfer as to invite the quench, and also to keep the associated parts sound or unaffected even when the quench occurs.

The factors in the entry or transfer of the heat into the superconducting magnet are classified into static factors and dynamic factors. Examples of the static factors are heat radiation and conduction of heat due to the temperature difference between the superconducting magnet and the exterior, and these cannot be avoided under any condition of use of the magnet. An example of the dynamic factor is the generation of heat by an eddy current induced by disturbances such as a relative vibration between the superconducting coil and the associated part (e.g., the radiation shield) and a variation or fluctuation of the external magnetic field. In the superconducting magnet in a stationary condition, the entry of heat due to the above dynamic factor can be neglected.

The above static factors are common to low-temperature devices, and have sufficiently been taken into consideration in the prior art techniques. Namely, the radiation shield 3 and the heat-insulating vacuum vessel 4 are the most basic parts for reducing the entry of heat thereinto due to the heat conduction and the heat radiation. In the conventional superconducting magnets, in addition to using these parts, various means have been adopted in order to further reduce the heat entry and to ensure a mechanical strength thereof when the quenching occurs. For example, in a superconducting magnet disclosed in Japanese Patent Unexamined Publication No. 1-115107, a low-resistivity material is mounted on a superconducting-coil container over an entire circumference of the superconducting-coil container in order to prevent the deformation of a radiation shield due to an electromagnetic force generated when the quenching occurs.

However, in the prior art, sufficient consideration has not been given to the heat entry due to the dynamic factor. The only means heretofore used for dealing with this heat entry have at best been to install the superconducting magnet in a place not subjected to an external magnetic field variation, and to change the position of mounting of devices, such as a cooling pump, so that mechanical vibrations will not be applied to the superconducting magnet. However, with an increasing application of the superconducting magnet, the superconducting magnet is not always used in a stationary condition in which the superconducting magnet is not subjected to dynamic disturbances. Moreover, it can reasonably be expected that the superconducting magnet is used in a free space where an unexpected disturbance may develop. In such a case, it is necessary to take countermeasures against the above-mentioned dynamic factor. The simplest countermeasure that can be considered is to enhance the cooling ability of the superconducting magnet; however, the problems with this countermeasure are an increased size of the magnet and an increased consumption of electric power. Another countermeasure that can be considered is to reduce the eddy current which is the root cause for the heat generation, or to reduce the resistivity of the superconducting-coil container so that the heat generation will not occur even when the eddy current flows. In the prior art technique disclosed in the above Japanese Patent Unexamined Publication No. 1-115107, there is a possibility that the generation of heat by the eddy current flowing in the superconducting-coil container may be reduced because of the provision of the low-resistivity material covering the superconducting-coil container, although this prior art invention is directed to a different object. In this prior art technique, however, there arise the following problems since the resistance of the superconducting-coil container over the entire circumference thereof extending along the superconducting coil is reduced. First, since the eddy current easily flows when exciting the superconducting coil, the current tending to flow through the superconducting coil will be suppressed by the eddy current, and therefore the rise time required for activating the superconducting magnet, as well as the required electric power, will be increased. If the power supply is enhanced in order to provide the increased power and to shorten the rise time, the generation of heat by the eddy current becomes higher, so that the quench will be liable to occur.

SUMMARY OF THE INVENTION

It is a first object of this invention to provide a superconducting magnet which can suppress the generation of heat by an eddy current induced by a magnetic field variation due to causes such as vibration, thereby preventing a quench, without affecting the rise time required for achieving a desired level of persistent current in the superconducting coil.

A second object of the invention is to provide a superconducting magnet which can suppress the generation of heat by an eddy current, thereby preventing a quench, even during exciting or energizing the superconducting magnet and also even when a magnetic field variation due to causes such as vibration occurs.

A third object of the invention is to provide such a superconducting magnet as described above for the first and second objects, in which the magnet is not increased in size.

To achieve the above objects, at least a part of a superconducting-coil container is made of a high-resistivity material higher in resistivity than the remainder of the superconducting-coil container.

To achieve the above objects, the superconducting-coil container is so constructed that a time constant of an eddy current flowing in the coil container is longer than a time constant of a magnetic variation or mechanical vibration applied to the coil structure from the exterior.

To achieve the above objects, the superconducting-coil container has a closed loop construction which is made of a low-resistivity material lower in resistivity than other associated parts, and forms a closed loop in the circumferential direction of the superconducting-coil container, and at least a part of the closed loop construction is made of a high-resistivity material higher in resistivity than the above low-resistivity material.

According to a preferred embodiment, the high-resistivity portion or the portion made of the high-resistivity material is provided at a position where an external magnetic field variation is small, or a relative vibration between the superconducting-coil container and other constituent part in which an eddy current flows is small.

To achieve the third object, a closed loop construction, which is made of a low-resistivity material lower in resistivity than the superconducting-coil container, and forms a closed loop in the circumferential direction of this coil container, is provided between the superconducting coil and a radiation shield, and at least a part of the closed loop construction is made of a high-resistivity material higher in resistivity than the low-resistivity material.

First, the function or operation of the superconducting magnet structure according to the invention will be described briefly. During the rise time required for energizing the superconducting magnet, an eddy current is produced in the superconducting-coil container in its circumferential direction. Therefore, if the resistivity over the entire circumference is increased, the eddy current can be suppressed. As a result, the adverse effect of suppressing the current flowing in the superconducting coil is lowered, and therefore the rise of the current can be quickened. Also, since the eddy current can be suppressed, the heat generation can be reduced to suppress the quench. The resistivity over the entire circumference can be increased by providing a high-resistivity portion at a part of the superconducting-coil container. In this case, if the superconducting-coil container has a doughnut-shape, the high-resistivity portion quite effectively interrupts the eddy current which should flow along a closed loop in the circumferential direction of the superconducting-coil container, and also quite effectively reduces the heat generation. On the other hand, when the magnetic field, at a region of the coil container, generated by the superconducting coil is varied by a disturbance such as vibration after the superconducting coil has been energized, the eddy current is produced locally in the superconducting-coil container. In this case, when this local portion is decreased in resistivity so as to allow the eddy current to flow therein to a certain extent, the heat generation can be kept to a low level. Therefore, the superconducting-coil container is designed to have a closed loop construction which is made of a low-resistivity material lower in resistivity than the other constituent members (associated parts), and forms a closed loop in the circumferential direction of the superconducting-coil container, and at least a part of this closed loop construction is formed by a high-resistivity material higher in resistivity than the above low-resistivity material. With this arrangement, the above objects of the invention can be achieved. When vibration occurs, the generation of heat in the high-resistivity portion becomes large relatively, and therefore if this portion is supported so as to suppress the vibration of the high-resistivity portion, the overall heat generation can be suppressed.

The operation will now be described in detail. First, explanation will be made of how the generation of heat in the superconducting-coil container by the eddy current is reduced. Most simply, the eddy current in the superconducting-coil container is expressed by the following equation (1):

$$LdI(t)/dt+RI(t)+d\psi(t)/dt=0 \quad (1)$$

where L represents a self-inductance of the superconducting-coil container, R represents a resistance of the superconducting-coil container, I represents a value of the eddy current in the superconducting-coil container, and $\psi$ represents a magnetic flux which intersects the superconducting-coil container due to an external disturbance. The equation (1) indicates that the eddy current is induced by a change of the flux (which intersects the superconducting-coil container) with time. The following equation (2) is obtained by Laplace transformation of the equation (1):

$$I(s)=s\psi(s)/\{L(s+1/\tau\} \quad (2)$$

where $\tau=L/R$.

The behavior of the eddy current in the superconducting-coil container can be understood by examining a Bode diagram of the equation (2). This Bode diagram is shown in FIG. 3. In FIG. 3, lines 6, 7 and 8 indicate three cases where their resistances R1, R2 and R3 are different from one another (R1>R2>R3). Each of these lines 6, 7 and 8 represents the ratio of the eddy current I to the amount of change of the flux $\psi$ due to the disturbance with respect to the frequency f of the disturbance (indicated by the abscissa axis). In these three cases, the self-inductance L is constant, and therefore with respect to eddy current time constants $\tau 1$ (=L/R1), $\tau 2$ (=L/R2) and $\tau 3$ (=L/R3), the relation ($\tau 1<\tau 2<\tau 3$) is established. As will be appreciated from FIG. 3, the eddy current increases with the increase of the frequency of the disturbance, but when this frequency exceeds the frequency $\frac{1}{2}\pi\tau$ determined by the eddy current time constant, the eddy current stays at a constant value. The lower the resistance, the lower the frequency at which the eddy current becomes constant. The generation of heat W by the eddy current is represented by the following equation (3):

$$W(s)=RI^2(s)=(R/L^2)\{s^2\psi^2(s)/(s+1/\tau)^2\} \quad (3)$$

The frequency characteristic of the heat generation by the eddy current (represented by the equation (3)) are shown in FIG. 4. In FIG. 4, the abscissa is the same as that of FIG. 3, and the ordinate represents the ratio of the Joule heat W to the square $\psi^2$ of the flux due to the disturbance. 6',7' and 8' correspond in resistance to 6, 7 and 8 in FIG. 3. As will be appreciated from FIG. 4, the heat generation increases with the increase of the frequency of the disturbance, as is the case with the eddy current in FIG. 3, and when this frequency exceeds the frequency $\frac{1}{2}\pi\tau$ determined by the eddy current time constant, the heat generation is stays at a constant value proportional to the resistance. Therefore, if the resistance is so determined that the maximum frequency fd of the disturbance applied to the superconducting magnet can be greater, as at 9 in FIG. 4, than the frequency determined by the eddy current time constant, the lower the resistance, the smaller the heat generation by the eddy current. If the above disturbance is mechanical vibration, the maximum frequency of the disturbance corresponds to a frequency such as the maximum resonant frequency of the mechanical system. If the disturbance is a magnetic field variation, the maximum frequency of the disturbance corresponds to a frequency such as the frequency of the power supply for a device for generating the magnetic field. In both cases, the maximum frequency of the disturbance can be easily known in accordance with the condition of use of the superconducting magnet, and therefore the heat generation will not be increased by erroneously determining the resistance.

Thus, in the present invention, by defining the relation between the frequency of the disturbance and the resistance of the superconducting-coil container, there can be achieved the situation in which although the eddy current flows, the heat generation is small. Further, the eddy current, flowing in the superconducting-coil container, decreases the magnetic field fluctuation applied to the superconducting coil, and therefore is effective in achieving the purpose of avoiding occurrence of the quench. However, with only such arrangements, the other problems with the prior art, that is, the increased time for exciting or energizing the superconducting coil and the increased power consumption, cannot be solved. Therefore, in the present invention, attention is directed to the fact that the eddy current produced at the time of the excitation or energization flows along the circumferential direction of the superconducting coil, whereas the flow path of the eddy current due to the disturbance is determined by the nature of the disturbance, without preference of the circumferential direction of the superconducting coil. Taking this into consideration, the high-resistivity portion is provided at that place where the eddy current due to the disturbance is the least liable to flow, in such a manner that the high-resistivity portion extends across the flow path of the eddy current produced at the time of the excitation. With this arrangement, the high-resistivity portion offers a high resistance to the eddy current produced at the time of the excitation, and therefore the a smaller eddy current flows, thereby preventing the increase of the time required for the excitation, as well as the increase of the power consumption. On the other hand, a small resistance is offered to the eddy current due to the disturbance, and therefore the heat generation will not be unduly increased by the provision of the high-resistivity portion. The above-mentioned place(s) where the eddy current due to the disturbance is the least liable to flow is/(are) the place(s) subjected to a small influence of the external magnetic field variation, or the place(s) where a relative vibration between the superconducting-coil container and another constituent member (through which the eddy current flows) is small. This place can be suitably specified in accordance with the construction of the superconducting magnet and the condition of use thereof.

In the foregoing, explanation has been made of the case or embodiment where the present invention is applied to the superconducting-coil container. However, in the superconducting magnet, the eddy current flows in those portions at which the eddy current can easily flow. In other words, in the above example, the eddy current can easily flow in the superconducting-coil container. Generally, the radiation heat shield is provided outside of the superconducting-coil container, and the radiation heat shield is made of a low-resistivity material, and the eddy current can easily flow in the radiation heat shield. Therefore, in many cases, some means is provided on at least one of the superconducting-coil container and the radiation heat shield. From the technical concept of the present invention, when a place or a portion where the eddy current can easily flow exists between the superconducting coil and the radiation heat shield, similar effects as achieved by the superconducting-coil container can be attained by providing similar measures on that portion. Namely, a closed loop structure, formed of a low-resistivity material lower in resistivity than the superconducting-coil container, is provided between the superconducting coil and the radiation shield to form a closed loop in the circumferential direction, and at least a part of the closed loop construction is made of a high-resistivity material higher in resistivity than the above low-resistivity material. In this case, because of the added material, this superconducting magnet becomes larger in size than the superconducting magnet comprising the superconducting coil and the radiation shield.

DESCRIPTION OF THE PREFERRED EMBODIMENTS

Figure 1A:
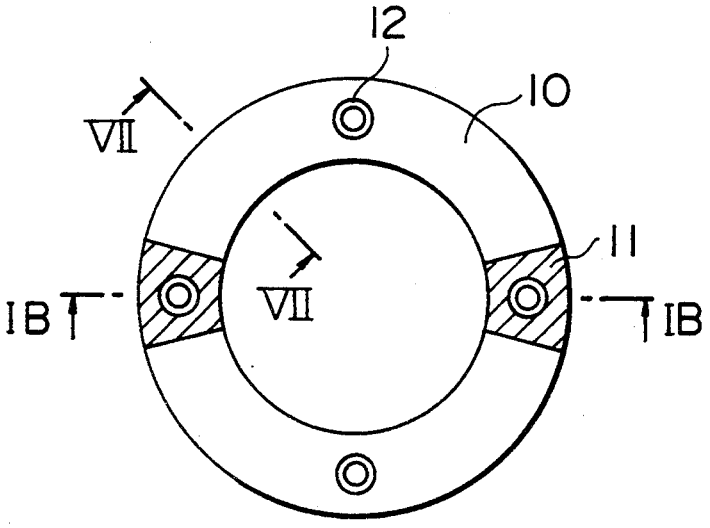
FIG. 1A is a plan view of a superconducting-coil container according to a preferred embodiment of the present invention.
Figure 1B:
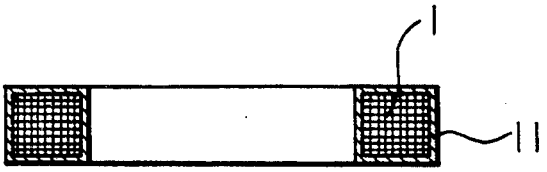
Fig. 1B is a cross-sectional view taken along the line IB—IB of FIG. 1A.
Figure 2:
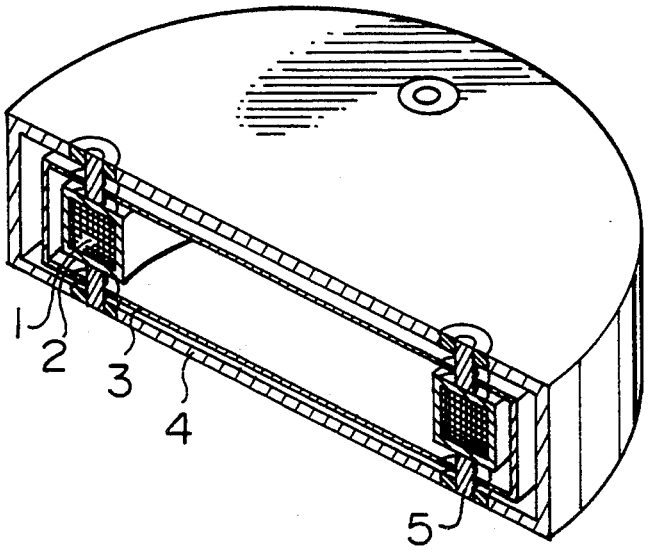
FIG. 2 PRIOR ART
FIG. 2 is a perspective view of a half section of the construction of a conventional superconducting magnet.
Figure 3:
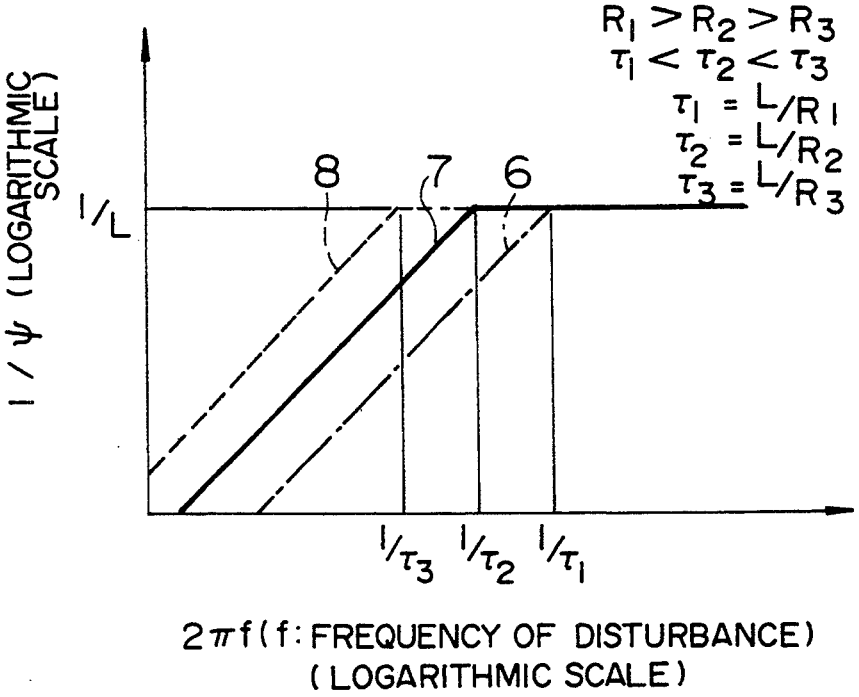
FIG. 3 is a diagram explanatory of the effect by an embodiment of the present invention, showing the relation between the frequency of a disturbance and an eddy current due to this disturbance.
Figure 4:
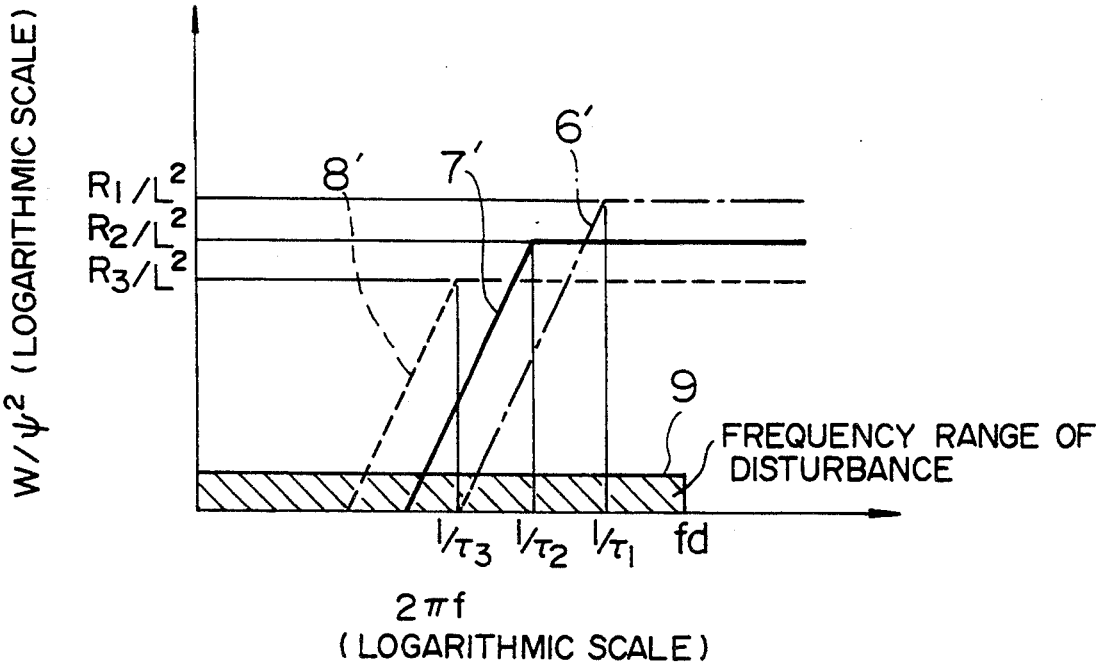
FIG. 4 is a diagram explanatory of the effect by an embodiment of the present invention, showing the relation between the frequency of the disturbance and the generation of heat by the eddy current.

One preferred embodiment of the present invention will now be described with reference to FIGS. 1A and 1B. FIGS. 1A and 1B show a structure of a superconducting-coil container of this embodiment, which corresponds to the conventional superconducting-coil container 2 of FIG. 2. In FIGS. 1A and 1B, reference numeral 10 denotes a low-resistivity portion, reference numeral 11 a high-resistivity portion, and reference numeral 12 a mounting portion for a support member 5. In this embodiment, most of the superconducting-coil container is constituted by a low-resistivity material, and two portions 11 of the superconducting-coil container are made of a high-resistivity material. These two portions of the high-resistivity material are provided respectively at two of the support member mounting portions 12 in surrounding relation thereto. The manner of flow of the eddy current in the superconducting-coil container of this structure will be described with reference to FIGS. 5B and 6B.

Figure 5A:
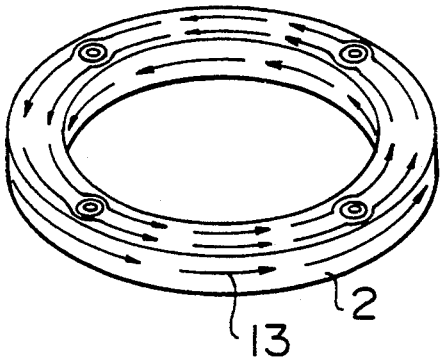
FIG. 5A PRIOR ART
FIG. 5A is a view showing flow paths of the eddy current in the superconducting-coil container of the prior art at the time of excitation.
Figure 5B:
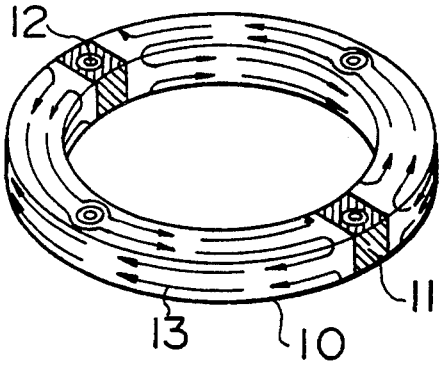
FIG. 5B is a view showing flow paths of the eddy current in the superconducting-coil container according to an embodiment of the present invention at the time of excitation.
Figure 6A:
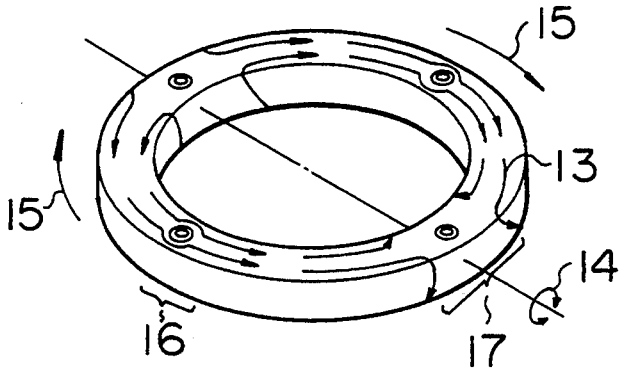
FIG. 6A PRIOR ART
FIG. 6A is a view showing flows paths of the eddy current in the superconducting-coil container of the prior art when a vibration disturbance is applied.
Figure 6B:
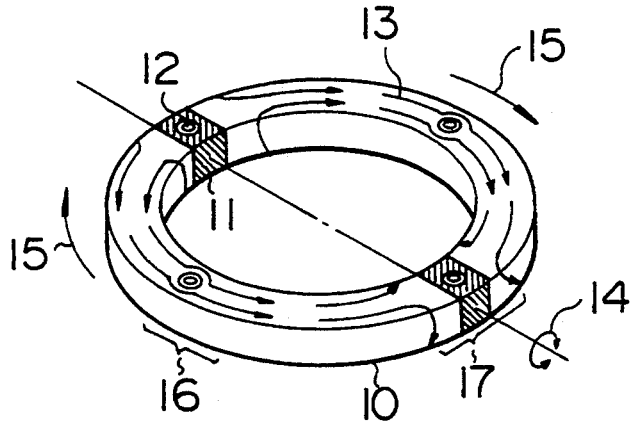
FIG. 6B is a view showing flow paths of the eddy current in the superconducting-coil container according to an embodiment of the present invention when a vibration disturbance is applied.

FIG. 5B shows the manner of flow of the eddy current produced when exciting or energizing a superconducting coil, in comparison with that of the prior art shown in FIG. 5A. Arrows 13 indicate the direction of flow of the eddy current. In the prior art, when the current of the superconducting coil is increased, the eddy current 13 flows in a direction opposite to the direction of flow of the superconducting coil current as shown in FIG. 5A, thereby producing an electromotive force which tends to prevent the increase of the superconducting coil current. On the other hand, in this embodiment, as shown in FIG. 5B, the eddy current 13 flows substantially only in the low-resistivity portion 10 in a circulating manner, and hardly flows in the high-resistivity portions 11. As a result, the amount of the eddy current flowing in the direction opposite to the direction of flow of the superconducting coil current as in the prior art is small, and therefore the electromotive force which tends to prevent the increase of the superconducting coil current is small. FIGS. 6A and 6B show the manner of flow of the eddy current when a relative vibration between the superconducting-coil container and a radiation shield (not shown) or a heat-insulating vacuum vessel (not shown) occurs or develops. The manner of development of the relative vibration is changed in various manners, depending on the manner of application of an external force, a support structure, and so on. However, the problem to be seriously considered causing large eddy current to flow is a low-order mode such as a rigidity displacement and a low-order bending. FIGS. 6A and 6B shows the eddy current when the relative displacement occurs in a direction indicated by arrow 15 upon generation of the rigid body rotation mode (typical example of the low-order mode) in a direction indicated by arrow 14. In the prior art of FIG. 6A, the eddy current flows most intensely at those portions 16 where the relative displacement is the maximum, and also flows most weakly at those portions 17 where the relative displacement is the minimum. On the other hand, in this embodiment of FIG. 6B, the high-resistivity portions 11 correspond to the portions 17 of the minimum relative displacement, and therefore the manner of flow of the eddy current is the same as that of the prior art of FIG. 6A. Generally, the relative displacement is smaller in the vicinity of the support member mounting portions 12 than at the other portions, and therefore by providing the high-resistivity portion 11 around the support member mounting portion 12 as in this embodiment, the heat generation by the eddy current due to the relative displacement between the constituent members of the superconducting magnet can be made small. As described with reference to FIGS. 5B and 6B, in this embodiment, the eddy current can be made small when exciting the superconducting coil, that is, when energizing the superconducting magnet, and the rise time of current to a desired level is not affected, and besides the heat generation by the eddy current due to the dynamic disturbance can be suppressed.

The manner of mechanical vibration applied to the superconducting magnet from the exterior, as well as the mode of vibration of the superconducting magnet caused by such mechanical vibration, can be known beforehand from the structure of the superconducting magnet and the condition of use thereof. Therefore, if the high-resistivity portions are provided only around those of the plurality of the support member mounting portions at which the displacement is least liable to occur, the heat generation can be most effectively reduced.

As described above, in this embodiment, even when the superconducting magnet is used under the condition undergoing the mechanical vibration, the increase of the heat generation in the very low-temperature portion can be suppressed to a low level. Therefore, the reliability of the magnet is enhanced, and besides the capacity of a refrigerating machine can advantageously be small.

Figure 7A:
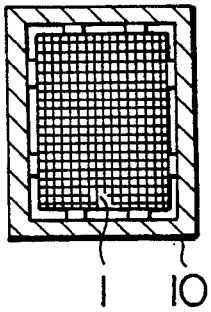
FIGS. 7A and 7B are sectional views along a line VII—VII of FIG. 1A each showing a low-resistivity portion in an embodiment of the present invention.
Figure 7B:
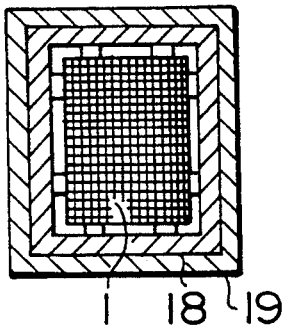

With respect to the preferred embodiment of the present invention shown in FIG. 1A, each of FIGS. 7A and 7B shows a cross-sectional structure of the low-resistivity portion 10 taken along the line VII—VII of FIG. 1A. In FIG. 7A, the low-resistivity portion 10 is formed of a single material. With this construction, there is an advantage that the manufacture is easy. As this low-resistivity material, aluminum, copper or an alloy thereof can be used. In FIG. 7B, the low-resistivity portion is made of a composite material. In this example of FIG. 7B, the low-resistivity portion comprises a high-resistivity material 18, and a low-resistivity material 19 laminated onto the outer surface of the high-resistivity material 18. Usually, a high-rigidity material, such as stainless steel and Inconel, can be used as the high-resistivity material. Therefore, in this example, advantageously, the superconducting-coil container material can be reduced as a whole in thickness because of the use of the composite material. Another advantage is that if the high-resistivity material 18 is the same material as that of the high-resistivity portion 11, the manufacture of the superconducting-coil container is easy.

Figure 8:
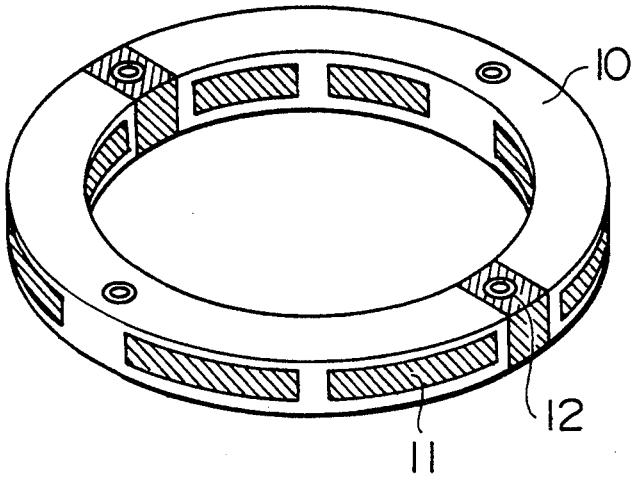
FIG. 8 is a perspective view of a superconducting-coil container according to a modified embodiment of the present invention.

Another embodiment of the present invention will be now be described with reference to FIG. 8. FIG. 8 shows an appearance of a superconducting-coil container which is generally similar to the first embodiment of FIGS. 1A and 1B, but differs therefrom in that a low-resistivity portion 10 is not uniform but has window-like notches. The eddy current due to the disturbance does not flow uniformly as in FIG. 6B, but those portions where the eddy current is strong and those portions where the eddy current weak are present in the low-resistivity portion. In this embodiment, high-resistivity portions 11 replace those portions of the above-mentioned low-resistivity portion 10 where the eddy current is weak. Therefore, in this embodiment, the area of the low-resistivity portion can be reduced without affecting the effect of the above first embodiment, and therefore the manufacture of the superconducting-coil container is easy. Although not shown in FIG. 8, a liquid helium pipe and lead wires of the superconducting coil are actually mounted in the superconducting-coil container, and it is often necessary to provide notches in the vicinity of these parts as in this embodiment.

Figure 9:
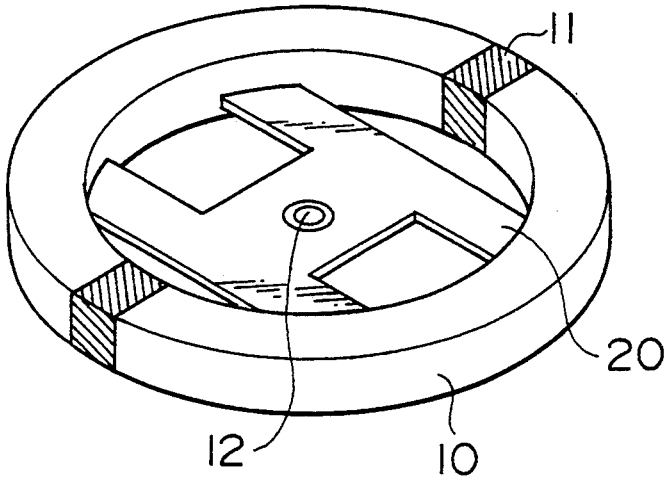
FIG. 9 is a perspective view of a superconducting-coil container according to another modified embodiment of the present invention.

A further embodiment of the present invention will now be described with reference to FIG. 9. FIG. 9 shows an appearance of a superconducting-coil container which is generally similar to the first embodiment of FIGS. 1A and 1B, but differs therefrom in that the positions of a support member mounting portion 12 and high-resistivity portions 11 are different from those in FIGS. 1A and B. In some superconducting magnets, a support member is not mounted directly on a superconducting-coil container, but is mounted thereon via another support member 20 as in this embodiment. In such a case, the point of support of the superconducting-coil container does not always coincide with the position of the minimum displacement. In this case, it is preferred that high-resistivity portions 11 are provided at the positions of the minimum displacement. However, if the support member mounting portions 12 is disposed at a center of symmetry of the coil as in this embodiment, the position of the minimum displacement can not be determined only by the position of the support member mounting portion 12. Even in such a case, the manner of the displacement can be known beforehand from the superconducting magnet structure and the kind of the disturbance, for example, through a structure analysis, and therefore it is possible to specify the positions of the minimum displacement and then to provide the high-resistivity portions there. As described above, in this embodiment, even when the support member mounting portion is not provided directly on the superconducting-coil container, the generation of heat by the eddy current due to the disturbance can be reduced.

Figure 10:
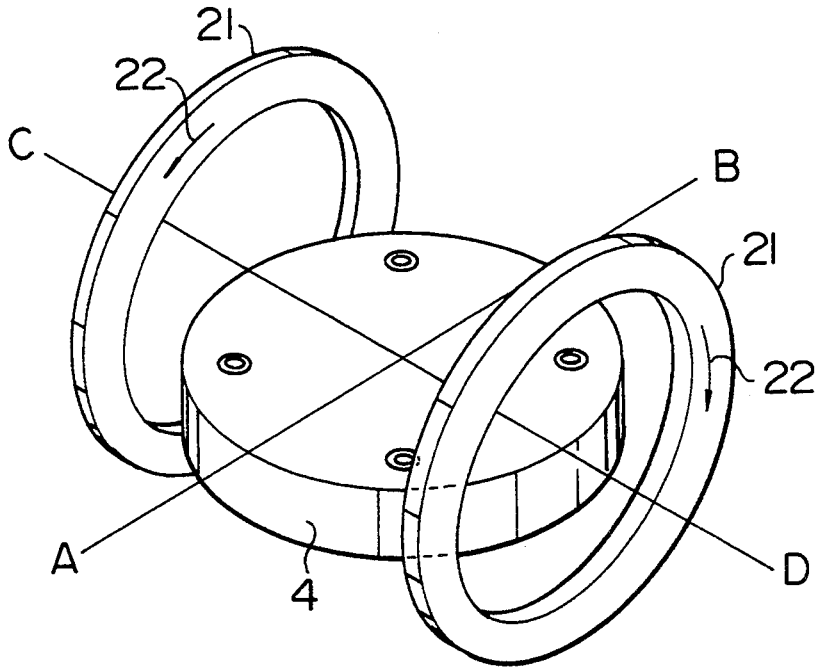
FIG. 10 is a perspective view showing the relation of coils to a superconducting magnet according to an embodiment of the invention.
Figure 11:
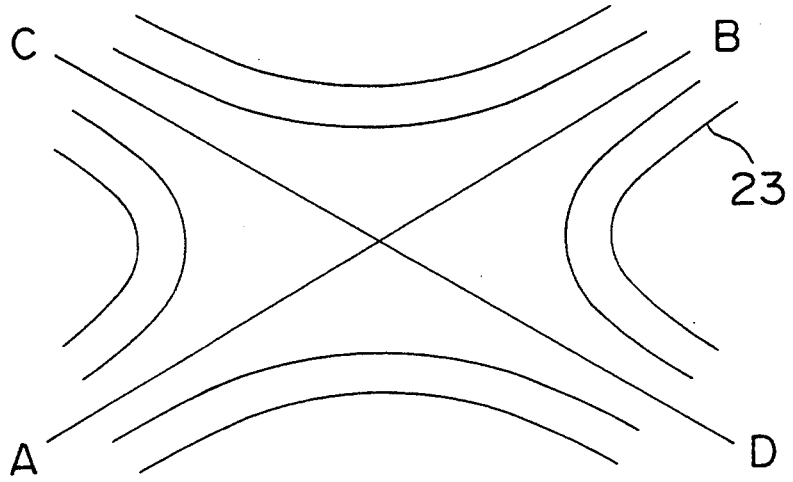
FIG. 11 is a schematic view showing a distribution of the flux density produced by the coils of FIG. 10.
Figure 12:
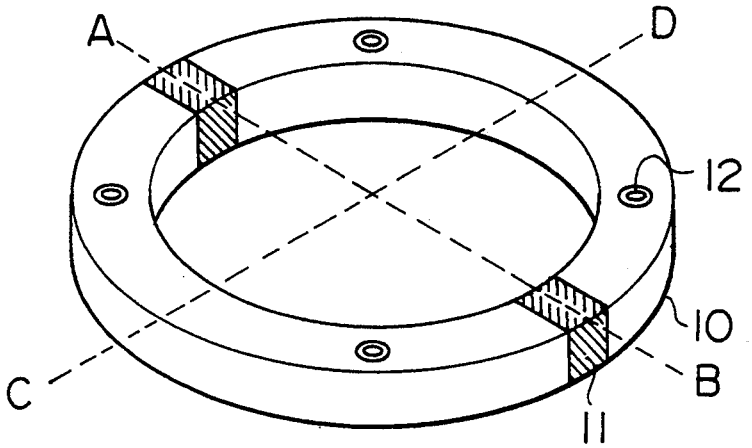
FIG. 12 is a perspective view of a superconducting-coil container of the superconducting magnet of FIG. 10.

A further embodiment of the present invention will now be described with reference to FIGS. 10, 11 and 12. FIG. 10 shows the environment in which a superconducting magnet is used in a nuclear fusion apparatus, and this constitutes a background of this embodiment. In FIG. 10, reference numeral 4 denotes a heat-insulating vacuum vessel in which a superconducting-coil container (not shown) is contained. Coils 21 are provided independently of the superconducting magnet, and current flows in the coils 21 in a direction of arrow 22. In this structure, when the superconducting magnet is used, magnetic field variations of the coils 21 are applied as a dynamic external disturbance to the superconducting magnet. In this embodiment, it is intended to reduce the eddy current heat generation in the superconducting-coil container by this dynamic magnetic field variation. Although the above embodiments except for this embodiment are constructed to deal with the vibration disturbance, they can achieve quite the same effect with respect to the magnetic field disturbance. However, in the above embodiments, in order to reduce the eddy current heat generation as much as possible, the high-resistivity portions are provided at those portions where the relative displacement by the vibration disturbance is small. Therefore, from the same viewpoint, it is effective to provide the high-resistivity portions at those portions where the magnetic field disturbance is the minimum. FIG. 11 shows a magnetic flux density distribution which is produced by the coils 21 of FIG. 10 at a certain time, and is shown in a plane indicated by A, B, C and D of FIG. 10. In FIG. 11, reference numeral 23 denotes lines of the same density of magnetic flux. In FIG. 11, the coil currents are equal to each other, and a change of the flux is the minimum on the line extending between A and B. In FIG. 12, based on this fact, the high-resistivity portions 11 are provided at those portions of the superconducting-coil container disposed on the line extending between A and B. Referring to the difference between the first embodiment of FIGS. 1A and 1B and this embodiment of FIG. 12, in FIGS. 1A and 1B, the high-resistively portion is provided around the support member mounting portion, whereas in FIG. 12, irrespective of support member mounting portions 12, the high-resistivity portions 11 are provided at those portions where the magnetic field disturbance is the minimum. The magnitude of the disturbance applied to the superconducting magnet, as well as the eddy current due to this disturbance which flows in the superconducting-coil container, are determined by the structure of the magnet and the nature of the disturbance, and these can be predicted beforehand as shown in FIG. 11 of this embodiment. Therefore, the position of the high-resistivity portion which most effectively reduces the eddy current heat generation can be easily determined. As described above, in this embodiment, in the superconducting magnet on which the magnetic field disturbance strongly acts, the generation of heat by the eddy current due to the disturbance can be reduced without increasing the time required for exciting the superconducting coil and also without increasing the capacity of the power supply.

Figure 13A:
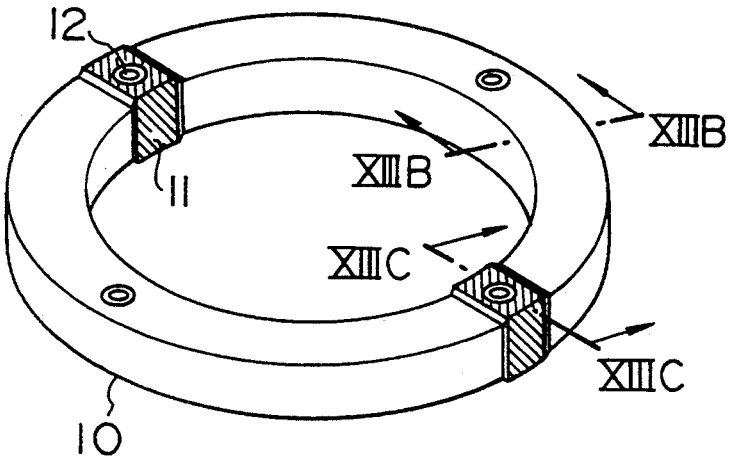
FIG. 13A is a perspective view of superconducting-coil container according to a further modified embodiment of the invention.
Figure 13B:
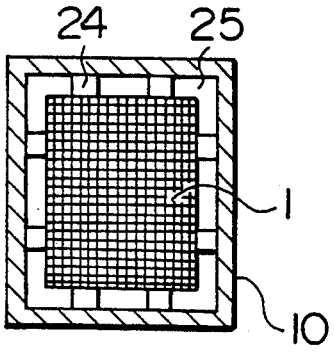
FIG. 13B is a cross-sectional view taken along the line XIIIB—XIIIB of FIG. 13A.
Figure 13C:
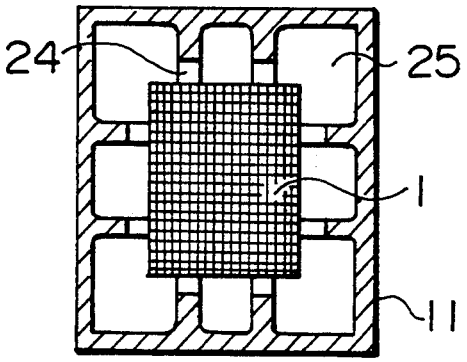
FIG. 13C is a cross-sectional view taken along the line XIIIC—XIIIC of FIG. 13A.

A further embodiment of the present invention will now be described with reference to FIGS. 13A and 13B. FIG. 13A shows a superconducting-coil container which is generally similar to the first embodiment of FIGS. 1A and 1B, but differs therefrom only in that a high-resistivity portion 11 has a different cross-sectional shape. To better indicate this, the cross-section of a low-resistivity portion 10 taken along the line XIIIB—XIIIB of FIG. 13A and the cross-section of the high-resistivity portion 11 taken along the line XIIIC—XIIIC are shown in FIGS. 13B and 13C, respectively. In these figures, reference numeral 24 denotes a spacer, and reference numeral 25 is a coolant flow path. A superconducting coil 1 is supported on the superconducting-coil container through the spacers 24, and is maintained at a low temperature by a cooling medium, such as liquid helium, flowing through the coolant flow path 25. This embodiment is characterized in that the cross-sectional area of the coolant flow path 25 is greater at the high-resistivity portion 11 than at the low-resistivity portion 10. Even if the eddy current flows in the low-resistivity portion 10, the heat generation can be reduced to a small level by reducing its resistivity. On the other hand, the high-resistivity portion 11 generates a larger amount of heat even with a small current, as compared with the low-resistivity portion 10. As a result, in the superconducting magnet of this embodiment, most of the eddy current heat generation in the superconducting-coil container concentrates on the high-resistivity portions 11. Therefore, the cooling ability of the high-resistivity portion is made higher than that of the low-resistivity portion, and by doing so, the cooling can be efficiently carried out with a smaller flow rate of the coolant. Other methods than that of this embodiment that can be considered for making the cooling ability of the high-resistivity portion higher than that of the low-resistivity portion are, for example, to increase the number of coolant flow paths in the high-resistivity portion or to provide additional flow paths for cooling only the high-resistivity portions.

In the above description, the high-resistivity portions as at 11 in FIG. 9 form a closed loop in the circumferential direction of the superconducting-coil container. However, although the high-resistivity portions as at 11 in FIG. 8 do not always form a closed loop, the effect of the present invention can be achieved if the resistivity over the entire circumference is reduced.

The high-resistivity portion where resistance per unit length in the circumferential direction is high can be obtained by changing the thickness, instead of using the material different from that of the low-resistivity portion where resistance per unit length in the circumferential direction is lower than the high resistivity portion. Herein, the term "resistivity" is referred to as the meaning above.

In the above embodiments, although the measures are applied to the surface of the superconducting-coil container, a similar effect can be achieved by applying the measures on the inner surface thereof or within it.

Finally, in the superconducting magnet, the eddy current flows in those portions at which the eddy current can easily flow. In other words, in the above examples, the eddy current can easily flow in the superconducting-coil container. Generally, the radiation heat shield is provided outside of the superconducting-coil container, and the radiation heat shield is made of a low-resistivity material, and the eddy current can easily flow in the radiation heat shield. Therefore, in many cases, some means is provided on either the superconducting-coil container or the radiation heat shield. From the technical concept of the present invention, when a place or a portion where the eddy current can easily flow exists between the superconducting coil and the radiation heat shield, a similar effect as achieved by the superconducting-coil container can be attained by providing similar measures on that portion. Namely, a closed loop structure of a low-resistivity material which allows the eddy current to flow easily is provided between the superconducting coil and the radiation shield, and at least part of the closed loop structure is made of a high-resistivity material higher in resistivity than the above low-resistivity material.

In the present invention, the superconducting-coil container, constituting the superconducting magnet, comprises the low-resistivity portion and the high-resistivity portions, and the eddy current due to the dynamic disturbance flows in the portion of a low resistivity, and the eddy current produced when exciting the superconducting coil never fails to flow across the portion of a high resistivity. With this arrangement, the generation of heat by the eddy current due to the dynamic disturbance can be reduced without markedly increasing the time required for the excitation and also without increasing the capacity of the power supply.

What is claimed is:

1. A coil structure comprising:

a ring-shaped superconducting coil;

a hollow ring-shaped coil container for enclosing the superconducting coil and cooling the superconducting coil to a low temperature, wherein the coil container is made of electrically conductive material and has at least one support region; and a support structure for supporting the coil container at the at least one support region;

wherein the coil container includes at least one low resistivity portion made of electrically conductive material and having a low resistivity, and at least one high resistivity portion made of electrically conductive material and having a high resistivity higher than the low resistivity;

wherein the at least one low resistivity portion constitutes a major portion of the coil container;

wherein the at least one high resistivity portion includes at least one high resistivity portion forming a closed loop oriented such that the superconducting coil passes through the closed loop.

2. A coil structure according to claim 1, wherein each of the at least one high resistivity portion forming a closed loop includes a respective one of the at least one support region.

3. A coil structure according to claim 2, wherein the at least one high resistivity portion further includes at least one high resistivity portion which does not form a closed loop.

4. A coil structure according to claim 2, wherein the at least one high resistivity portion has a higher cooling ability for cooling the superconducting coil than does the at least one low resistivity portion.

5. A coil structure according to claim 2, wherein the coil container cools the superconducting coil to a low temperature with a coolant flowing in the coil container, and wherein the at least one high resistivity portion provides a higher coolant flow rate than does the at least one low resistivity portion.

6. A coil structure according to claim 2, wherein the coil container cools the superconducting coil to a low temperature with a coolant flowing in the coil container, and wherein the coil container provides at least one first coolant flow path for cooling both the at least one high resistivity portion and the at least one low resistivity portion, and at least one second coolant flow path for cooling only the at least one high resistivity portion.

7. A coil structure according to claim 2, wherein the coil container is constituted by an inner layer made of an electrically conductive material having a high resistivity and an outer layer made of an electrically conductive material having a low resistivity, the high resistivity being higher than the low resistivity;

wherein the inner layer is disposed in both the at least one low resistivity portion and the at least one high resistivity portion; and wherein the outer layer is disposed in only the at least one low resistivity portion.

8. A coil structure according to claim 7, wherein the at least one high resistivity portion further includes at least one high resistivity portion which does not form a closed loop.

9. A coil structure according to claim 7, wherein the at least one high resistivity portion has a higher cooling ability for cooling the superconducting coil than does the at least one low resistivity portion.

10. A coil structure according to claim 7, wherein the coil container cools the superconducting coil to a low temperature with a coolant flowing in the coil container, and wherein the at least one high resistivity portion provides a higher coolant flow rate than does the at least one low resistivity portion.

11. A coil structure according to claim 7, wherein the coil container cools the superconducting coil to a low temperature with a coolant flowing in the coil container, and wherein the coil container provides at least one first coolant flow path for cooling both the at least one high resistivity portion and the at least one low resistivity portion, and at least one second coolant flow path for cooling only the at least one high resistivity portion.

12. A coil structure according to claim 7, wherein the outer layer has at least one cut-out portion.

13. A coil structure according to claim 1, wherein the coil container is exposed to a varying external magnetic field, and wherein each of the at least one high resistivity portion forming a closed loop is disposed such that a variation in the external magnetic field at each of the at least one high resistivity portion forming a closed loop is smaller than a variation in the magnetic field at the at least one low resistivity portion.

14. A coil structure according to claim 13, wherein the at least one high resistivity portion has a higher cooling ability for cooling the superconducting coil than does the at least one low resistivity portion.

15. A coil structure according to claim 13, wherein the coil container cools the superconducting coil to a low temperature with a coolant flowing in the coil container, and wherein the at least one high resistivity portion provides a higher coolant flow rate than does the at least one low resistivity portion.

16. A coil structure according to claim 13, wherein the coil container cools the superconducting coil to a low temperature with a coolant flowing in the coil container, and wherein the coil container provides at least one first coolant flow path for cooling both the at least one high resistivity portion and the at least one low resistivity portion, and at least one second coolant flow path for cooling only the at least one high resistivity portion.

17. A coil structure according to claim 13, wherein the coil container is constituted by an inner layer made of an electrically conductive material having a high resistivity and an outer layer made of an electrically conductive material having a low resistivity, the high resistivity being higher than the low resistivity;

wherein the inner layer is disposed in both the at least one low resistivity portion and the at least one high resistivity portion; and wherein the outer layer is disposed in only the at least one low resistivity portion.

18. A coil structure according to claim 17, wherein the at least one high resistivity portion has a higher cooling ability for cooling the superconducting coil than does the at least one low resistivity portion.

19. A coil structure according to claim 17, wherein the coil container cools the superconducting coil to a low temperature with a coolant flowing in the coil container, and wherein the at least one high resistivity portion provides a higher coolant flow rate than does the at least one low resistivity portion.

20. A coil structure according to claim 17, wherein the coil container cools the superconducting coil to a low temperature with a coolant flowing in the coil container, and wherein the coil container provides at least one first coolant flow path for cooling both the at least one high resistivity portion and the at least one low resistivity portion, and at least one second coolant flow path for cooling only the at least one high resistivity portion.

21. A coil structure according to claim 17, wherein the outer layer has at least one cut-out portion.

* * * * *